US007377225B2

(12) United States Patent
Finn et al.

(10) Patent No.: US 7,377,225 B2
(45) Date of Patent: May 27, 2008

(54) SPAR-TYPE OFFSHORE PLATFORM FOR ICE FLOW CONDITIONS

(75) Inventors: Lyle Finn, Sugar Land, TX (US); Atle Steen, Cardiff by the Sea, CA (US)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 11/462,959

(22) Filed: Aug. 7, 2006

(65) Prior Publication Data

US 2008/0029013 A1 Feb. 7, 2008

(51) Int. Cl.
*B63B 35/44* (2006.01)
*B63B 22/02* (2006.01)

(52) U.S. Cl. ..... 114/264; 441/4

(58) Field of Classification Search ..... 114/264
See application file for complete search history.

(56) References Cited

U.S. PATENT DOCUMENTS 3,921,558 A * 11/1975 Redshaw ..... 114/256
6,012,873 A 1/2000 Copple et al.
6,092,483 A 7/2000 Allen et al.
6,227,137 B1 5/2001 Allen et al.
6,263,824 B1 7/2001 Balint et al.
6,666,624 B2 12/2003 Wetch
6,786,679 B2 9/2004 Huang et al.
6,968,797 B2 11/2005 Persson
7,101,117 B1 * 9/2006 Chow ..... 405/201
7,197,999 B2 * 4/2007 Murray ..... 114/264

FOREIGN PATENT DOCUMENTS

WO WO 2006/042178 4/2006

* cited by examiner

*Primary Examiner*—Jesús D Sotelo
(74) *Attorney, Agent, or Firm*—Klein, O'Neill & Singh, LLP; Howard J. Klein

(57) ABSTRACT

A spar-type platform includes a hull defining a centerwell extending downward to a keel. The hull includes a reduced diameter neck portion for diverting ice flow. Adjustable ballast tanks allow the hull to be moved between a ballasted down position defining an upper water line, and a ballasted up position defined by a lower water line. A riser a support buoy is disposed in the keel. Risers extend through the centerwell, each having an upper portion extending upward from the support buoy and a lower portion supported in the support buoy. A disconnect system detachably connects the support buoy to the hull and the upper portion of each riser to the lower portion thereof, whereby the hull and the upper portion of each riser are selectively detachable from the buoy and the lower portion of each riser for movement to avoid a collision with a floating object.

21 Claims, 6 Drawing Sheets

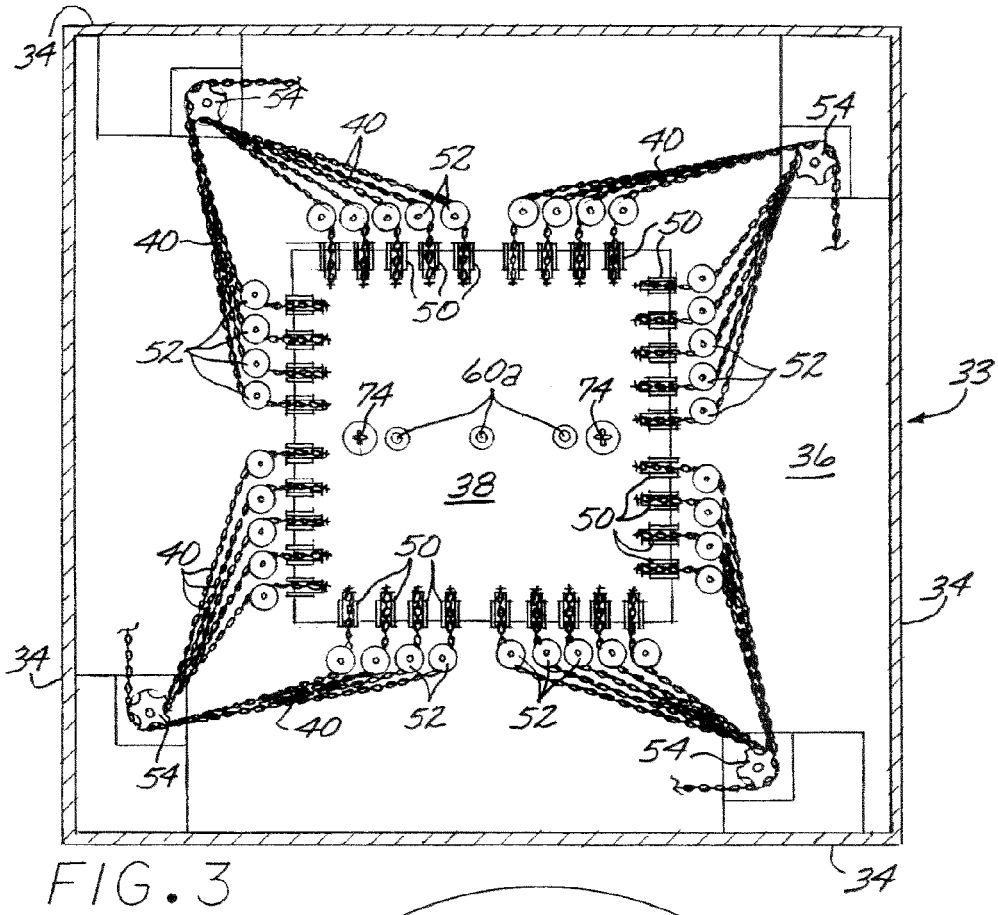
FIG. 3
FIG. 4
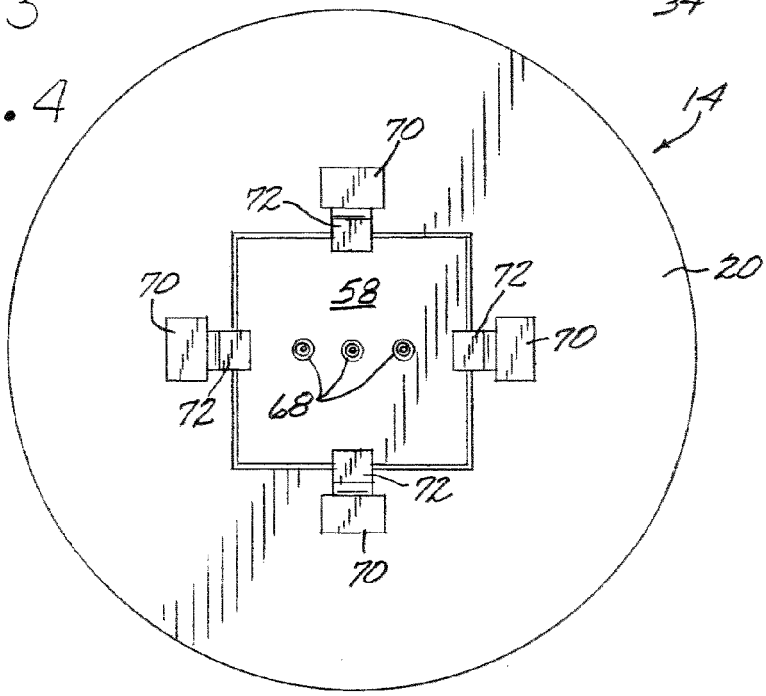

SPAR-TYPE OFFSHORE PLATFORM FOR ICE FLOW CONDITIONS

CROSS-REFERENCES TO RELATED APPLICATIONS

Not applicable

FEDERALLY SPONSORED RESEARCH OR DEVELOPMENT

Not applicable

BACKGROUND OF THE INVENTION

The present invention relates generally to floating offshore production vessels for oil and gas, and in particular, to a deepwater spar vessel for ice flow conditions.

The arctic regions of the world are known to contain appreciable hydrocarbon reserves (petroleum and natural gas), and exploitation of these reserves is likely to occur in the near future. Some of these hydrocarbon reserves are in deep water, and currently there is not a proven floating system for the production of petroleum and natural gas from deep water in areas where ice flow conditions are common.

Icebergs and ice flow conditions existing in the arctic regions create a major hurdle to deepwater drilling operations. Ice flow from sheets of ice is caused by environmental forces, such as water currents and wind acting on the ice. A drilling platform may be severely damaged if left to take the full impact of the crushing force of ice flow conditions or left to suffer a collision with an iceberg.

Drilling platforms not suited for ice flow conditions must be removed to safer waters until the ice is sufficiently melted. Many work hours as well as production hours are lost during removal of a drilling platform as a result of severe ice flow conditions or an approaching iceberg.

Previous systems exist that melt or break ice flow as the ice flow approaches the drilling platform. Other systems suggested are structures that are physically capable of withstanding the crushing forces of ice flow. Still other systems use structures that merely redirect ice flow. These systems are typically costly and/or impractical. Further, these systems do not provide an efficient means for removal of the drilling platform in the face of an imminent iceberg collision.

Of the several generic types of offshore platforms for the exploitation of undersea hydrocarbon reserves, the spar-type platform is most promising for arctic conditions, since it has a smaller water plane area than other designs, and thus has a smaller hull section exposed to ice flows. Nevertheless, spar-type platforms can still suffer damage by ice flows, and destruction by icebergs, and are thus not suitable, in their present state of the art, for areas where these phenomena are prevalent.

A need therefore exists for a drilling platform system that can be quickly and efficiently moved temporarily to avoid an imminent iceberg collision, and that can still be quickly and easily restored to its original operation position after the possible danger has passed. It would also be advantageous to provide such a platform with the ability to withstand ice flow conditions.

SUMMARY OF THE INVENTION

Broadly, the present invention is a spar-type platform that comprises an elongate buoyant hull supporting a deck and extending vertically from the deck to a keel, the hull having an axial centerwell extending through its length and a reduced-diameter cylindrical neck section below a lower or "ice-flow" water line; a riser a support buoy disposed in the bottom of the centerwell at the keel of the hull; one or more risers extending through the centerwell, each of the risers having an upper portion extending from the deck to the top of the support buoy and a lower portion supported in the support buoy; and a disconnect system detachably connecting the riser support buoy to the hull and the upper portion of each riser to the lower portion thereof, whereby the hull and the upper portion of each riser are selectively detachable from the buoy and the lower portion of each riser for movement to avoid a collision with a floating object, such as an iceberg, and whereby the hull and the upper portion of each riser are re-connectable to the buoy and the lower portion of each riser after the danger of a collision has passed.

More specifically, the hull comprises an upper cylindrical section attached to the deck and connected to the reduced-diameter neck section by an upper tapered section. An upper or "ice-free" water line is defined around the upper cylindrical hull section, while the lower or "ice-flow" water line is defined around the upper tapered hull section. A plurality of adjustable or "soft" ballast tanks surround the centerwell, into which seawater can be selectively and adjustably introduced or evacuated with forced air to provide adjustable ballast for the hull. In normal (ice-free) conditions, the hull is ballasted down to the upper or "ice-free" water line, in which the reduced-diameter neck section is totally submerged. When ice flow conditions are encountered, the ballast is reduced so that the hull rises slightly to the lower or "ice-flow" water line, thereby bringing the reduced-diameter neck section closer to the surface so as to reduce the hull area exposed to ice flows.

Each riser in the riser assembly includes an upper riser portion that extends through the centerwell and that is detachably coupled, at the riser support buoy, to a lower riser portion that extends through the riser support buoy to the seabed. In a preferred embodiment, the disconnect system comprises a remotely operable riser coupler that releasably couples the upper portion of each riser to the lower portion thereof, a latch mechanism that is remotely-operable to releasably secure the buoy to the keel of the hull; and a buoy lowering mechanism, comprising a plurality of buoy chains or cables, each of which is detachably connected to the buoy and wound on a deck-mounted winch that is selectively operable to lower the buoy when the riser coupler(s) and the latch mechanism are released, and to raise the buoy back up into the keel when it is desired to re-connect the buoy to the hull.

In a preferred embodiment of the present invention, a plurality mooring lines enter the hull below the reduced-diameter neck section, and upon entering the hull are directed to a substantially vertical orientation by bending shoes mounted in the hull. The mooring lines extend upwardly through the hull to chain stoppers, located above the neck section, that take up the vertical forces on the mooring lines. At the top of the hull, the mooring lines pass over a series of sheaves that redirect the lines to tensioning windlasses.

In use, when it is desired to move the platform out of the path of an iceberg the riser coupler(s) and the latch mechanism are respectively actuated so as to disconnect the upper portions of each the riser from the lower portion thereof, and so as release the buoy from the keel. The winches are operated to lower the buoy out of the keel, and the buoy chains or cables are then detached from the buoy and recovered on the winches. This completes the separation of the hull from the buoy, the latter remaining fixed in place by the connection between the lower portion of each riser and the seabed. Finally, the mooring lines are cut just below the chain stoppers, allowing the hull and the deck of the platform to be moved (either by towing or by self-propulsion) out of harm's way. When the iceberg has passed, the hull and deck are moved over the buoy; the mooring lines are recovered and reattached to the hull, the buoy chains or cables are attached to the buoy; and, using the winches, the buoy is hauled upwardly into centerwell at the keel of the hull. Finally, the latching mechanism is actuated to secure the buoy to the hull, and the upper and lower portions of each riser are coupled together with a riser coupler.

BRIEF DESCRIPTION OF THE DRAWINGS

FIG. 3 is a cross-sectional view taken along lines 3-3 of FIG. 2A;

FIG. 4 is a bottom plan view of the platform of FIG. 1, taken along line 4-4 of FIG. 2B;

DETAILED DESCRIPTION OF THE INVENTION

Figure 1:
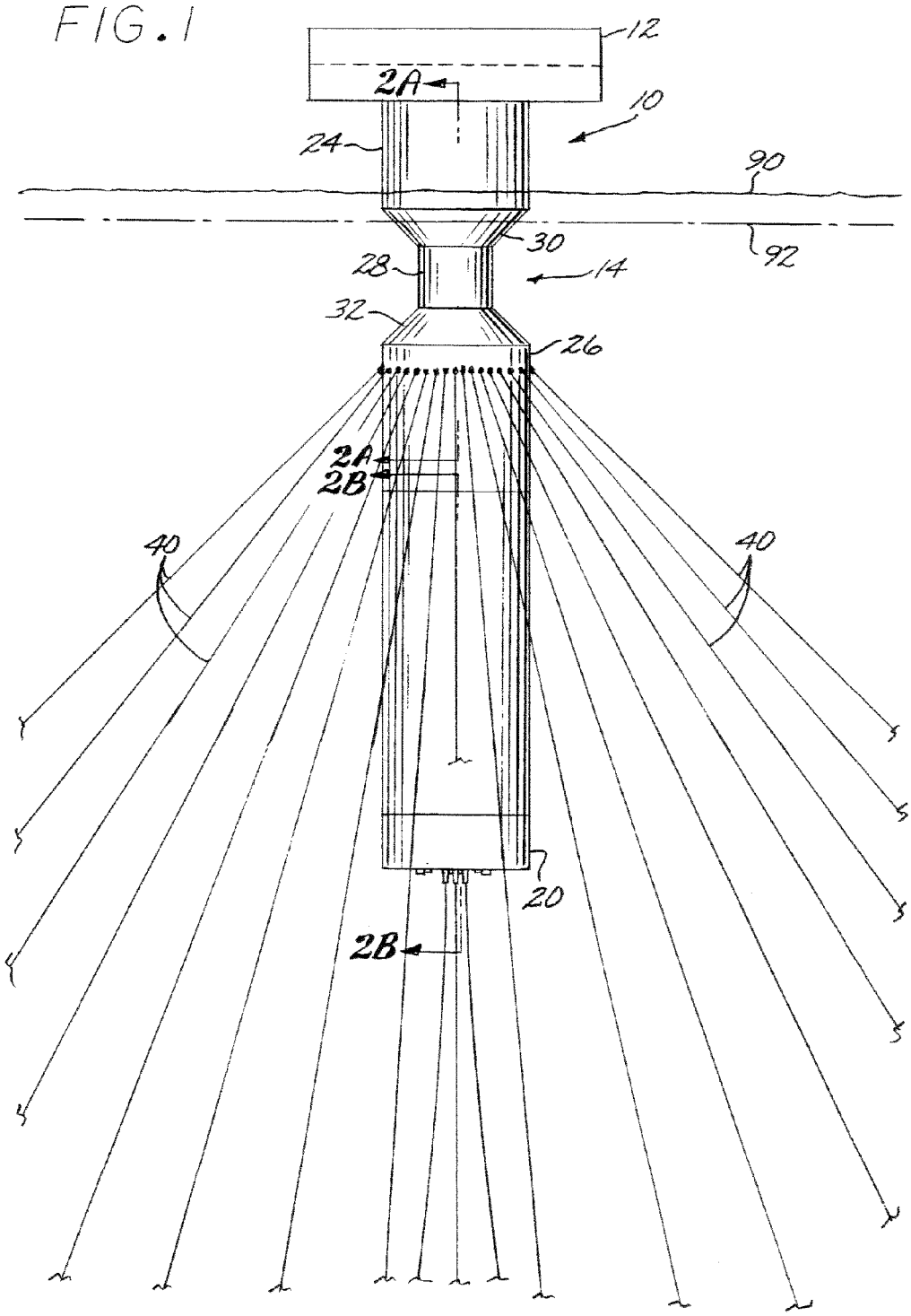
FIG. 1 is a side elevational view of a spar-type platform in accordance with the present invention.

Referring first to FIGS. 1, 2A, 2B, 3, and 4, a spar-type platform 10, in accordance with the present invention, is shown. The platform 10 includes a deck 12 and a hull 14. The hull 14 includes one or more hard tanks 16, one or more skirt tanks 18 and a ballasted keel or keel tank 20. As is typical with spar-type platforms the platform 10 is provided with a mechanism (not shown) for selectively filling and evacuating the skirt tank or tanks 18 with seawater ballast, for purposes to be described below. The hull 14 defines an axial centerwell 22 to be described more fully below, that extends to the keel 20. The hull 14 has an upper portion 24 secured to the deck 12, and a lower portion 26 extending upward from the keel 20. Between the upper hull portion 24 and the lower hull portion 26 is a reduced-diameter neck portion 28 that is joined to the upper hull portion 24 by a tapered (e.g., frusto-conical) upper transition portion 30, and to the lower hull portion 26 by a tapered (e.g., frusto-conical) lower transition portion 32. The purpose of the neck portion 28 will be explained below.

Contained within the upper hull portion 24 and secured to the underside of the deck 12 is an enclosed internal compartment 33 having a top portion defined by vertical upper side walls 34 attached between the deck 12 and the outer edges of a horizontal, inwardly-extending shelf 36, and a narrower bottom portion defined by vertical lower side walls 37 attached between the inner edges of the shelf 36 and a bottom wall 38. A plurality of mooring lines 40 (which may be cables or chains), securing the platform 10 to the sea bed, enter the lower portion 26 of the hull 14 below the neck portion 28, each of the mooring lines 40 passing through a hawser pipe 42 that extends to the exterior of the hull 14 with a water-tight fit. Each hawser pipe 42 engages one of a plurality of bending shoes 46 secured to the inner wall of the hull 14 near the lower end of the neck portion 28, thereby directing the mooring lines 40 into a substantially vertical orientation. Each hawser pipe 42 has an upper end that is secured in the bottom wall 38 of the internal compartment. Each of the mooring lines 40, after emerging from its corresponding hawser pipe 42, then passes through a corresponding one of a plurality of chain stoppers 48, secured to the upper surface of the bottom wall 38 of the compartment 33, which take up the vertical load of the mooring lines 40 and inhibit slippage in the mooring lines 40.

From the chain stoppers 48, each of the mooring lines 40 passes over a vertical sheave 50 attached to an inner edge of the shelf 36, and then over a horizontal sheave 52 (FIG. 3). The sheaves 50, 52 respectively direct the mooring lines 40 first from a vertical to a horizontal orientation, and then turn the mooring lines about 90° in the horizontal plane. As shown in FIG. 3, a windlass 54 is mounted in each corner of the shelf 36, and the mooring lines from the adjacent sheaves 50, 52 are wound on each windlass 54. In the specific example illustrated in the drawings, there are thirty-six mooring lines 40, with nine mooring lines 40 wound on each windlass 54. The windlasses 54 are operated so as to pay out the appropriate length of mooring line, and to apply the appropriate amount of tension to each line 40 to secure the platform 10. By enclosing the chain stoppers 48, the sheaves 50, 52, and the windlasses 54 in the compartment 33, these devices are shielded from harsh environmental conditions, such as wind and ice.

The centerwell 22 includes a horizontal bulkhead 56 that divides the centerwell into an upper centerwell portion 22*a* between the bottom wall 38 of the compartment 33 and the horizontal bulkhead 56, and a lower centerwell portion 22*b* between the horizontal bulkhead 56 and the top wall of a detachable riser support buoy 58 (described more fully below) installed in the bottom of the centerwell 22 at the keel 20 of the hull 14. The upper centerwell portion 22*a* defines an enclosure that provides some of the buoyancy lost due to the loss of hard tank capacity resulting from the smaller cross-sectional area of the neck portion 28 of the hull 14.

Extending through the centerwell 22 is a riser assembly comprising one or more risers, each of which comprises an upper riser portion 60*a* and a lower riser portion 60*b*. Each of the upper riser portions 60*a* is connected at its top end to production equipment (not shown) on the deck 12, while the bottom end of each upper riser portion 60*a* is connected to the top end of a corresponding lower riser portion 60*b* by a remotely-operable releasable riser coupler 62, of a type that is well-known and conventionally used in sub-sea petroleum and natural gas production systems. The couplers 62 may advantageously include self-sealing valves (not shown) to prevent or inhibit loss of fluid when the upper riser portions 60*a* are decoupled from the lower riser portions 60*b*, as described below. The section of each upper riser portion 60*a* that extends through the upper centerwell portion 22*a* may advantageously be enclosed in a protective upper riser sleeve 64.

The lower riser portions 60*b* are mounted in, and extend through, the detachable riser support buoy 58 that is seated below and coaxial with the centerwell 22 of the hull 14 at the keel 20. Preferably, each of the lower riser portions 60*b* passes through a lower riser sleeve 66 that extends axially through the riser support buoy 58. Each of the lower riser sleeves 66 terminates in a bend limiter 68 extending downwardly from the bottom of the support buoy 58. Each of the lower riser portions 60*b* then extends from one of the bend limiters 68 to a wellhead (not shown) in the seabed, as is well-known in the art.

The riser support buoy 58 is secured to the hull 14 by a remotely-operated latching mechanism comprising a plurality of latches 70 (FIGS. 2B and 4) mounted on the bottom of the keel 20, each having a latching element 72 that is engageable with the bottom of the riser support buoy 58. The latching mechanism is operable selectively to disengage the latching elements 72 from the support buoy, whereby the hull 14 of the platform 10 can be separated from the buoy 58, as described more fully below. Suitable latching mechanisms are well-known in the art, and have been used, for example, for releasably securing a buoy in a bow turret of a floating production, storage, and offloading (FPSO) vessel.

Figure 2A:
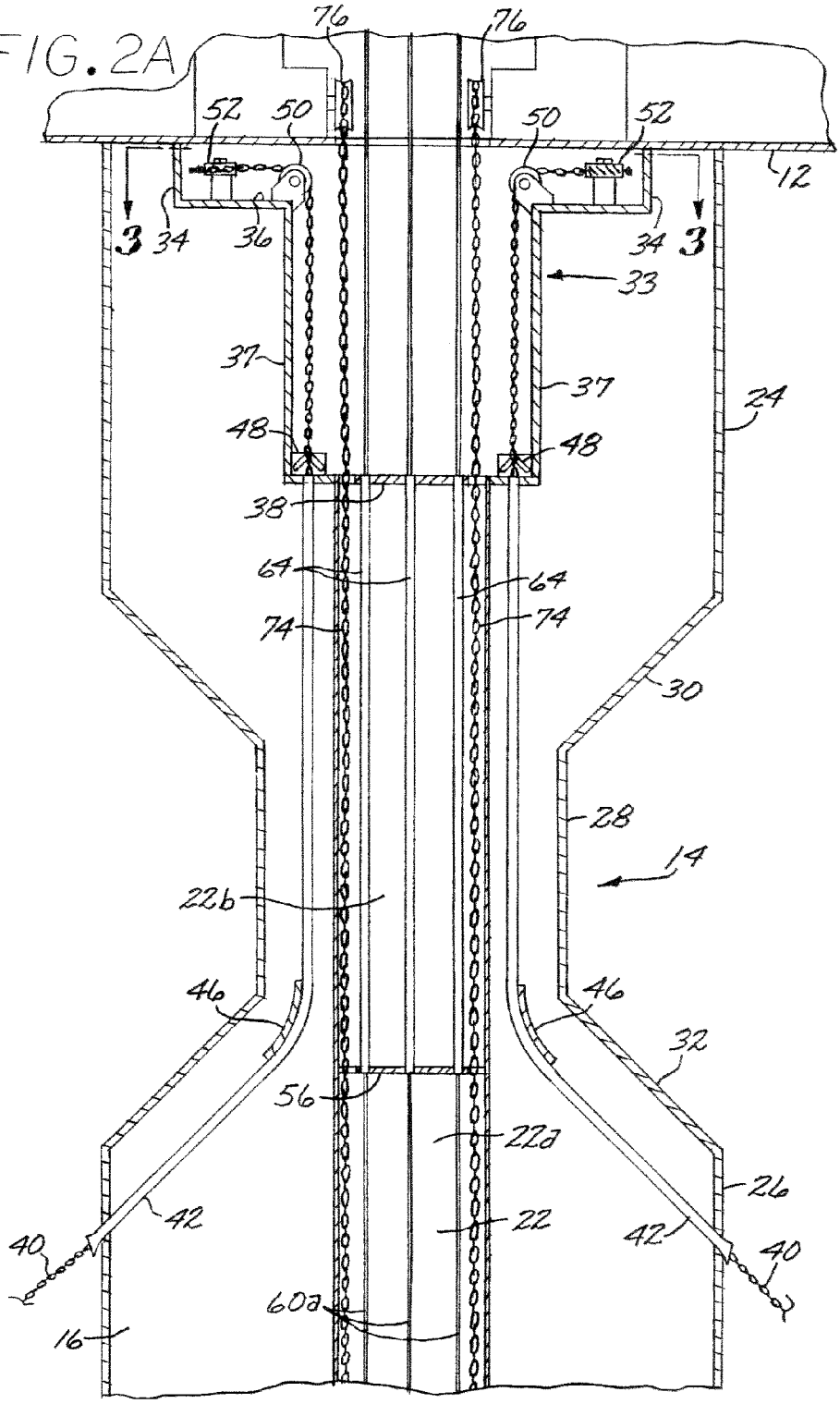
FIG. 2A is a cross-sectional view of the platform of FIG. 1, taken along line 2A-2A of FIG. 1.

As shown in FIGS. 2A and 23B, the buoy 58 is supported in the centerwell 22 by a plurality of buoy-lowering lines 74 (which may be cables or chains), each of which extends down the centerwell 22 from a winch 76 secured to the deck 12, passing through corresponding apertures in the bottom wall 38 of the enclosure 33, and in the centerwell horizontal bulkhead 56. The lower end of each of the cables or chains 74 terminates in a remotely-operable coupling socket 78 that releasably receives a mating ball 80 fixed to the top of the buoy 58 (see FIG. 8). The remotely-operable ball-and-socket coupling mechanism 78, 80 may be of any conventional design that is known in the art. Alternatively, the ball-and-socket coupling mechanism 78, 80 may be operated by a remotely-operated vehicle (ROV) (not shown). When the buoy 58 is secured and supported in its hull-attached or raised position within the centerwell 22 by the latches 70 and the lowering chains or cables 74, respectively, a first plurality of buoy stop elements 82, mounted around the periphery of the top of the buoy 58, seat against a corresponding second plurality of buoy stop elements 84 fixed to the top of the keel tank 20, as shown in FIG. 2B.

As described above, the platform 10 of the present invention is operable in at least two ways to minimize the risk of damage due to flow ice and icebergs. First, as shown in FIG. 1, the platform 10 has a first or "ballasted down" position, in which the neck portion 28 and the tapered upper transition portion 30 of the hull 14 are totally submerged below an upper or "ice-free" water line 90 that is defined on the upper hull portion 24 at a predetermined distance below the deck 12. The "ballasted down" position is used for conditions in which large waves may be encountered, but ice flow conditions do not exist. By evacuating some of the ballast from the skirt tank(s) 18, the platform 10 is movable to a second or "ballasted up" position during ice flow conditions. The controllable introduction and evacuation of ballast into and out of the skirt tank(s) 18 to create the ballasted up and ballasted down positions are performed by means well-known in the art, typically a system of conduits (not shown) and air pumps (not shown) that respectively admit seawater into the tank(s) 18 and blow the water out of them. In the ballasted up position, the upper part of the tapered upper transition portion 30 of the hull 14 is raised, so as to present a lower or "ice flow" water line 92, represented by a broken horizontal line in FIG. 1 extending across the upper transition portion 30, above which at least the upper part of the upper transition portion 30 of the hull 14 extends. In the ballasted up position, the upper transition portion 30 of the hull 14 is thus at the lower water line 92, and the reduced-diameter neck portion 28 is just below the lower water line 92. The hull 14, in this "ballasted up" position, thus presents the reduced cross-sectional areas of the upper transition portion 30 and the reduced-diameter neck portion 28 to the near-surface of the water, thereby reducing the surface area of the hull 14 that is exposed to flow ice impact.

When impact with an iceberg appears imminent, the hull 14 may be separated from the riser support buoy and moved out of harm's way by the process described below and illustrated in FIGS. 5-8.

Figure 2B:
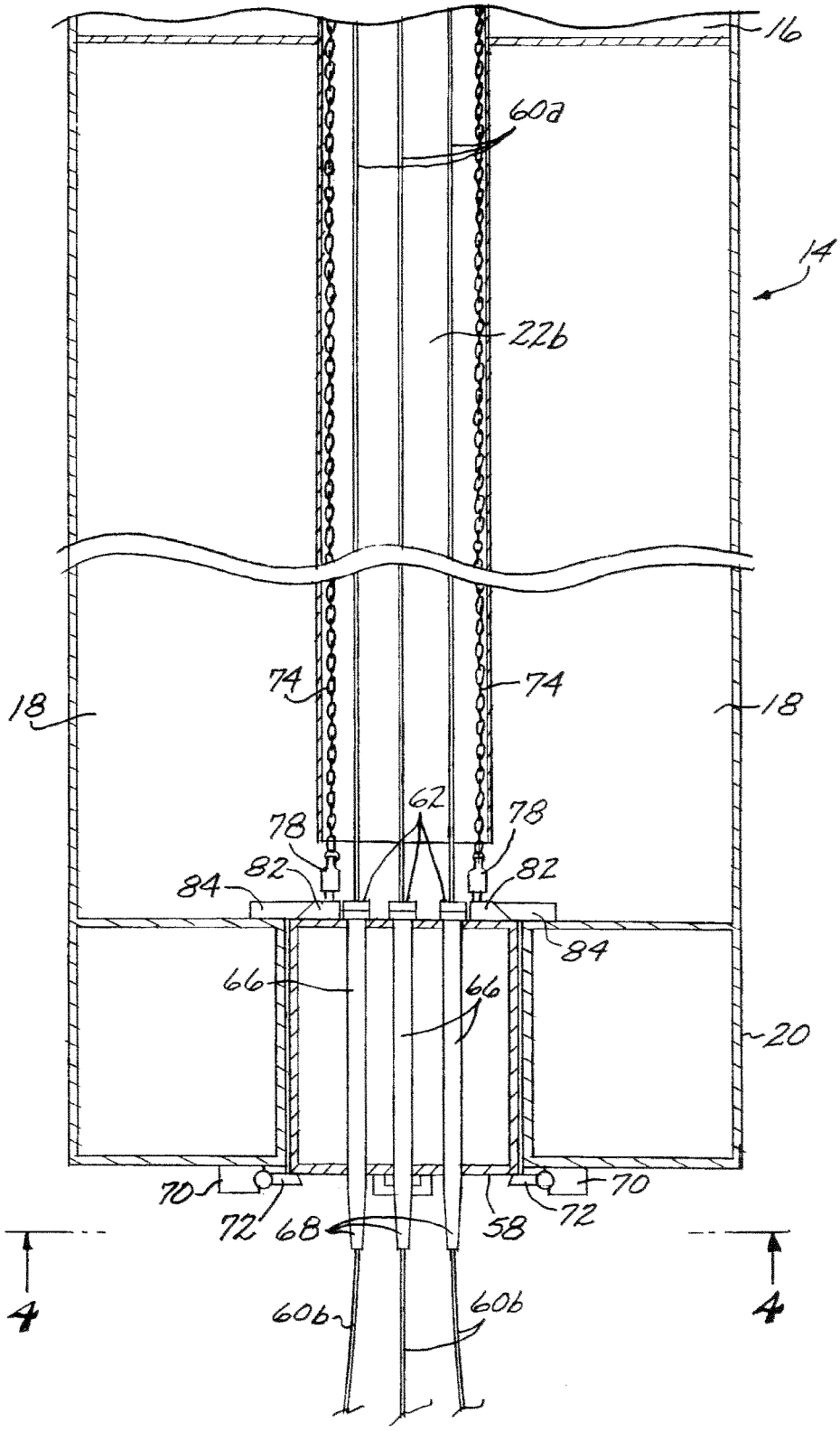
FIG. 2B is a cross-sectional view of the platform of FIG. 1, taken along lines 2B-2B of FIG. 1.
Figure 6:
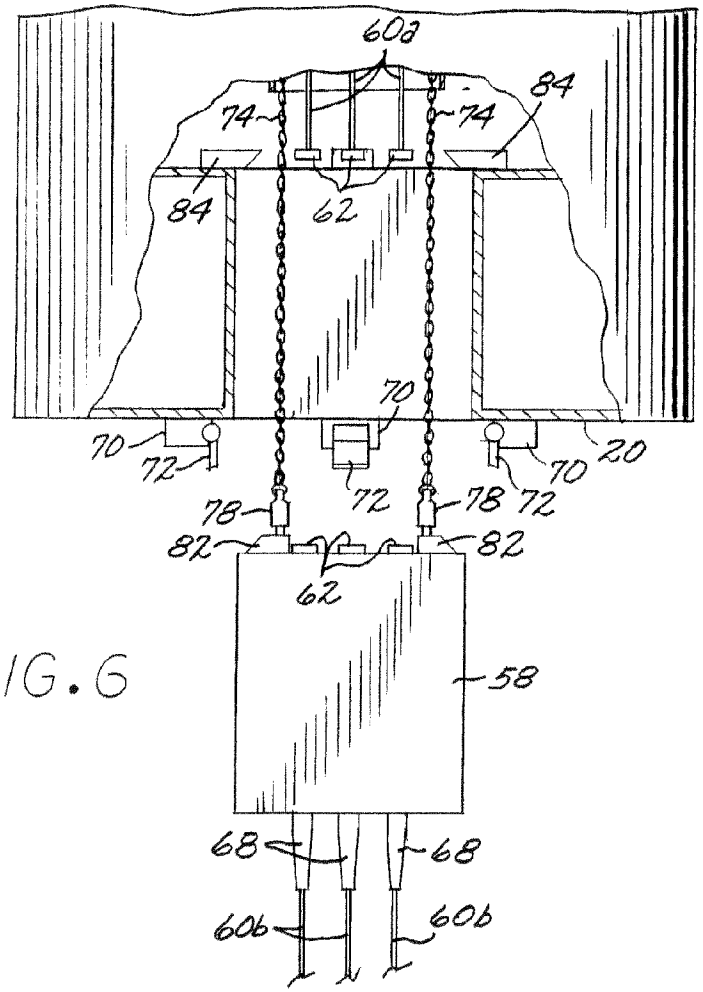
FIG. 6 is a side-elevational view, partially in cross-section, of the spar-type platform, showing the riser support buoy being lowered from the hull.
Figure 5:
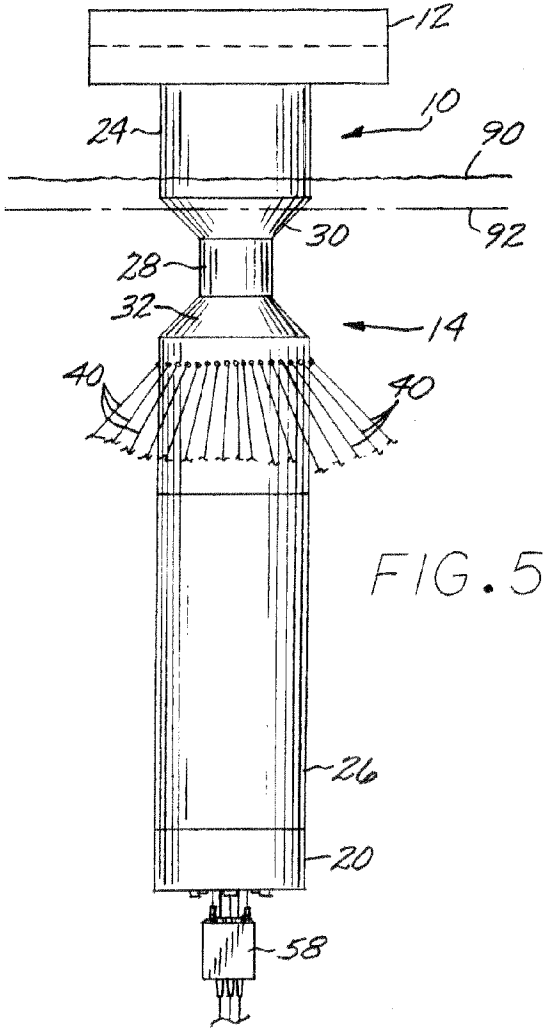
FIG. 5 is a side elevational view of a spar-type platform in accordance with the present invention, showing the riser support buoy of the present invention being lowered from the hull of the platform.

As shown in FIGS. 5 and 6, with reference also to FIGS. 2B and 4, the latches 70 securing the riser support buoy 58 to the hull are released, as are the riser couplers 62. These operations decouple the upper riser portions 60*a* from the lower riser portions 60*b*, while also detaching the buoy 58 from the hull 14. The riser buoy 58 is thereby freed to be lowered, relative to the hull 14, by means of the buoy-lowering cables or chains 74 and the winches 76, to a hull separation position, as shown in FIG. 6.

Figure 7:
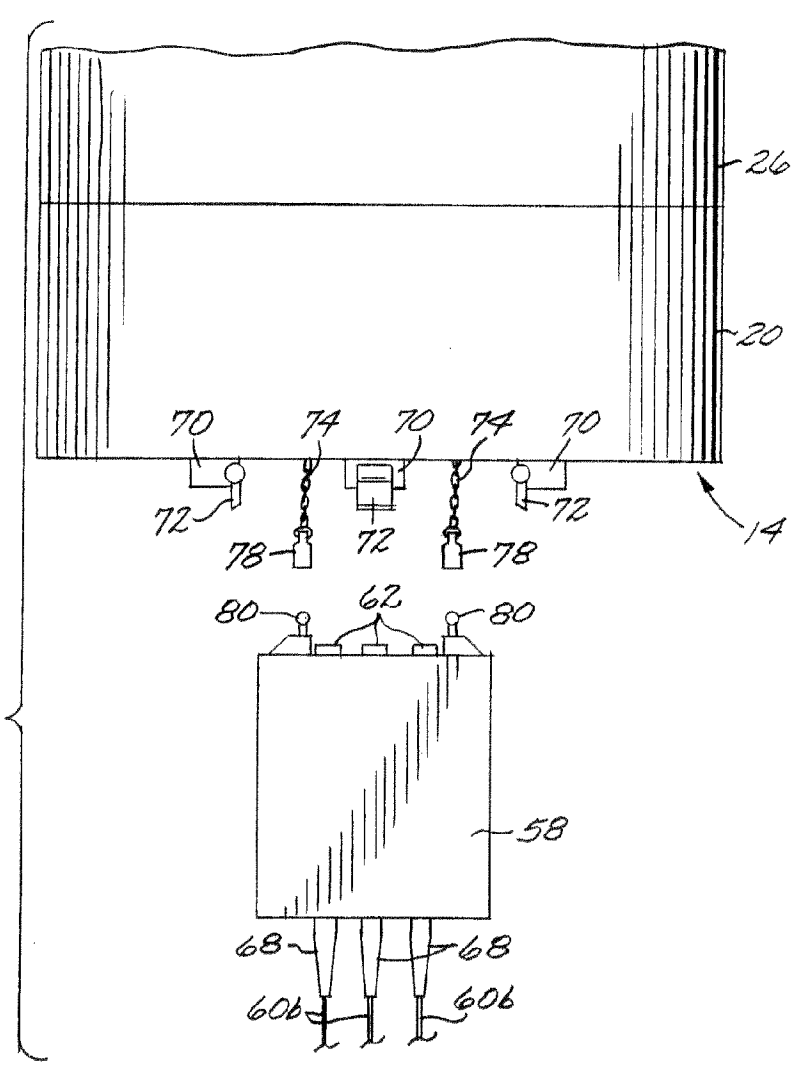
FIG. 7 is a side elevational view of a spar-type platform in accordance with the present invention, showing the riser support buoy of the present invention after separation from the hull of the platform.
Figure 8:
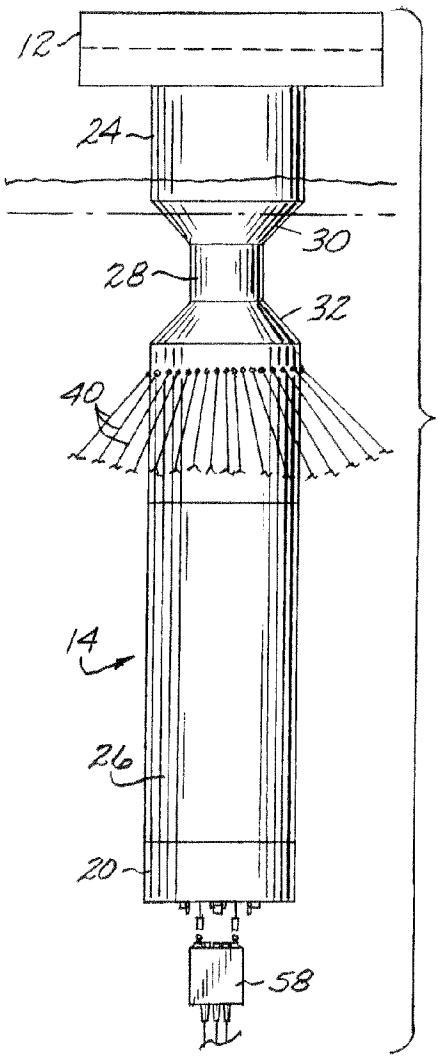
FIG. 8 is a side-elevational view of the spar-type platform showing the riser support buoy after separation from the hull.

As shown in FIGS. 7 and 8, after the buoy 58 is lowered to the hull separation position and has achieved a stable equilibrium position, the coupling sockets 78 are actuated so as to release the coupling balls 80, thereby completing the separation of the hull 14 from the buoy 58. The equilibrium position is a position where the buoyancy of the support buoy 58 maintains it at a certain depth that would be below any approaching iceberg and at which the buoy is not exposed to excessive wave action or water currents. A weighted object, such as a chain supported by a light-weight polyester line (not shown) may be attached to the support buoy 58 to help establish an equilibrium position.

If the hull and deck of the platform 10 are to be moved, the mooring lines 40 must then be severed, preferably at or just below the chain stoppers 48, and preferably after being slacked down a bit. The hull and deck may then be moved away, either by towing or by an onboard propulsion system (not shown). After the iceberg has passed or is otherwise deemed harmless, the hull and deck of the platform may be moved back over the buoy 58 for re-connection thereto by performing the above-described steps in reverse order after the mooring lines 40 have been re-connected. This reconnection may be performed, for example, by recovering the mooring lines 40 from the seafloor by attaching a retrieval line (not shown) to each of the mooring lines 40 using an ROV (not shown). Once the mooring lines are recovered to the surface, additional lengths of mooring line would be added, and the lines 40 would then be pulled through the hawser pipes 42 and secured by the chain stoppers 48.

Although the present invention has been described herein in the context of several exemplary embodiments, it will be understood that a number of variations and modifications may suggest themselves to those skilled in the pertinent arts. Such variations and modifications should be considered within the spirit and scope of the present invention, as defined in the claims that follow.

We claim:

1. A spar-type offshore platform for oil and gas drilling and production operations, comprising:

a hull having an axial centerwell extending to a keel;

a riser support buoy detachably disposed in the keel of the hull; and a riser comprising an upper riser portion passing through the centerwell and a lower riser portion supported in the riser support buoy and detachably connected to the upper riser portion;

whereby the hull and the upper riser portion are selectively detachable from the buoy and the lower riser portion for movement of the hull and the upper riser portion to avoid a collision with a floating object.

2. The spar-type platform of claim 1, wherein the hull includes an upper hull portion and a lower hull portion joined by a reduced diameter neck portion.

3. The spar-type platform of claim 2, wherein the reduced diameter neck portion is joined to the upper hull portion by a tapered transition portion.

4. The spar-type platform of claim 3, further comprising an adjustable ballast tank into which seawater ballast may be controllably introduced and from which seawater ballast may be controllably evacuated, so as to move the hull between a ballasted down position having an upper water line defined on the upper hull portion, and a ballasted up position having a lower water line defined on the transition portion.

5. The spar-type platform of claim 1, wherein the hull and the upper riser portion are detachable from the buoy and the lower riser portion by a disconnect system that comprises:

a riser coupler that releasably couples the upper riser portion to the lower riser portion;

a latch mechanism that releasably secures the buoy to the keel of the hull; and a buoy lowering mechanism that is selectively operable to lower the buoy when the riser coupler and the latch mechanism are released, and to raise the buoy back up into the keel to re-connect the buoy to the hull.

6. The spar-type platform of claim 5, wherein the buoy-lowering mechanism comprises:

a winch; and a plurality of buoy-lowering lines wound on the winch and detachably attached to the buoy.

7. The spar-type platform of claim 6, wherein the buoy-lowering lines extend through the centerwell.

8. The spar-type platform of claim 6, wherein the buoy-lowering lines are detachably attached to the buoy by a remotely-operable ball-and-socket mechanism.

9. The spar-type platform of claim 5, wherein at least one of the riser coupler and the latch mechanism is remotely-operable.

10. The spar-type platform of claim 9, wherein both the riser coupler and the latch mechanism are remotely-operable.

11. A spar-type offshore platform for oil and gas drilling and production operations, comprising:

a hull comprising an upper hull portion, a lower hull portion, and a reduced-diameter neck portion joining the upper hull portion and the lower portion, wherein the hull has a center-well extending axially to a keel;

a riser support buoy detachably disposed in the keel;

a riser comprising an upper riser portion passing through the centerwell and a lower riser portion supported in the riser support buoy and detachably connected to the upper riser portion; and an adjustable ballast mechanism that is operable to selectively move the hull between a ballasted down position in which an upper water line is defined across the upper hull portion, and a ballasted up position in which a lower water line is defined below the upper portion;

whereby the hull and the upper riser portion are selectively detachable from the buoy and the lower riser portion for movement of the hull and the upper riser portion to avoid a collision with a floating object.

12. The spar-type platform of claim 11, wherein the hull and the upper riser portion are detachable from the buoy and the lower riser portion by a disconnect system that comprises:

a riser coupler that releasably couples the upper riser portion to the lower riser portion;

a latch mechanism that releasably secures the buoy to the keel of the hull; and a buoy lowering mechanism that is selectively operable to lower the buoy when the riser coupler and the latch mechanism are released, and to raise the buoy back up into the keel to reconnect the buoy to the hull.

13. The spar-type platform of claim 12, wherein the buoy-lowering mechanism comprises:

a winch; and a plurality of buoy-lowering lines wound on the winch and detachably attached to the buoy.

14. The spar-type platform of claim 13, wherein the buoy-lowering lines extend through the centerwell.

15. The spar-type platform of claim 13, wherein the buoy-lowering lines are detachably attached to the buoy by a remotely-operable ball-and-socket mechanism.

16. The spar-type platform of claim 12, wherein at least one of the riser coupler and the latch mechanism is remotely-operable.

17. The spar-type platform of claim 16, wherein both the riser coupler and the latch mechanism are remotely-operable.

18. A method of moving a hull of a spar-type offshore platform for oil and gas drilling and production operation, comprising:

providing a floating hull secured to a seabed by a plurality of mooring lines, the hull having a centerwell extending to a keel;

detachably securing a riser support buoy in the keel of the hull;

providing a riser comprising an upper riser portion passing through the centerwell and a lower riser portion supported in the riser support buoy and connected to the seabed, the lower riser portion being detachably connected to the upper riser portion;

disconnecting the upper riser portion from the lower riser portion;

detaching the riser support buoy from the keel of the hull;

lowering the riser support buoy with the lower rise portion relative to the hull with a plurality of buoy lowering lines;

disconnecting the buoy lowering lines from the riser support buoy;

severing the mooring lines; and moving the hull and the upper riser portion away from the riser support buoy and the lower riser portion supported therein.

19. The method of claim 18, wherein at least one of the steps of disconnecting the upper riser portion from the lower riser portion, detaching the riser support buoy from the keel of the hull, and disconnecting the buoy lowering lines from the riser support buoy is performed remotely.

20. The method of claim 19, wherein the hull is ballast-adjustable so that it is selectively movable between a ballasted down position and a ballasted up position.

21. The method of claim 18, wherein the riser support buoy is re-attachable to the keel of the hull, the upper riser portion is re-attachable to the lower riser portion, and the buoy-lowering lines are re-attachable to the riser support buoy.

* * * * *